US010119433B2

(12) United States Patent
Boese

(10) Patent No.: US 10,119,433 B2
(45) Date of Patent: Nov. 6, 2018

(54) ROTOR FOR A VANE CELL ADJUSTER OF A CAMSHAFT ADJUSTING DEVICE

(71) Applicant: Schaeffler Technologies AG & Co. KG, Herzogenaurach (DE)

(72) Inventor: Olaf Boese, Nuremburg (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 458 days.

(21) Appl. No.: 14/890,281

(22) PCT Filed: Feb. 26, 2014

(86) PCT No.: PCT/DE2014/200084
§ 371 (c)(1),
(2) Date: Nov. 10, 2015

(87) PCT Pub. No.: WO2014/187451
PCT Pub. Date: Nov. 27, 2014

(65) Prior Publication Data

US 2016/0084121 A1 Mar. 24, 2016

(30) Foreign Application Priority Data

May 23, 2013 (DE) ..... 10 2013 209 520

(51) Int. Cl.
*F01L 1/344* (2006.01)

(52) U.S. Cl.
CPC ... *F01L 1/3442* (2013.01); *F01L 2001/34456* (2013.01); *F01L 2001/34469* (2013.01)

(58) Field of Classification Search
CPC ..... F01L 1/344; F01L 1/3442; F01L 2001/34456; F01L 2001/34469
USPC ..... 123/90.15, 90.17
See application file for complete search history.

(56) References Cited

U.S. PATENT DOCUMENTS

| | | | | |
|---|---|---|---|---|
| 6,945,205 | B2 | 9/2005 | Heintzen et al. | |
| 7,013,854 | B1 * | 3/2006 | Heintzen | F01L 1/3442 123/90.15 |
| 7,246,580 | B2 * | 7/2007 | Palesch | F01L 1/047 123/90.15 |
| 8,578,899 | B2 * | 11/2013 | Ottersbach | F01L 1/3442 123/90.15 |
| 8,635,978 | B2 | 1/2014 | Braun | |
| 9,004,025 | B2 | 4/2015 | Shinomiya | |

(Continued)

FOREIGN PATENT DOCUMENTS

| | | |
|---|---|---|
| CN | 102472126 | 5/2012 |
| CN | 102588028 | 7/2012 |

(Continued)

*Primary Examiner* — Phutthiwat Wongwian
*Assistant Examiner* — Loren Edwards
(74) *Attorney, Agent, or Firm* — Volpe and Koenig, P.C.

(57) ABSTRACT

A rotor (1) for a vane cell adjuster of a camshaft adjusting device including a central through opening (10) and at least one radially outwardly projecting vane (2). The rotor (1) is made of at least two parts, an inner part (8) made of a first material and an outer part (3) made of a second material and which surrounds, from the outside, the inner part (8). The first material has a higher strength than the second material, and the inner part (8) is connected in a positive fit in the rotational direction of the outer part (3) by an outer form which is irregular in the cross-section to the rotational axis (14) of the rotor (1).

10 Claims, 1 Drawing Sheet

(56) References Cited

U.S. PATENT DOCUMENTS

| | | | | |
|---|---|---|---|---|
| 2003/0037741 | A1 | 2/2003 | Kohrs | |
| 2004/0244745 | A1 | 12/2004 | Palesch et al. | |
| 2005/0034693 | A1 | 2/2005 | Heintzen et al. | |
| 2012/0060779 | A1* | 3/2012 | Adachi ..... | F01L 1/3442 123/90.15 |

FOREIGN PATENT DOCUMENTS

| | | |
|---|---|---|
| CN | 102947553 | 2/2013 |
| DE | 102004005822 | 8/2005 |
| EP | 1471215 | 10/2004 |
| EP | 2343438 | 7/2011 |
| JP | 2000161028 | 6/2000 |

* cited by examiner

ROTOR FOR A VANE CELL ADJUSTER OF A CAMSHAFT ADJUSTING DEVICE

BACKGROUND

The invention relates to a rotor for a vane cell adjuster of a camshaft adjusting device.

Camshaft adjusting devices comprise a camshaft and a vane cell adjuster that has, in its basic construction, a stator that can be driven by a crankshaft and a rotor locked in rotation with the camshaft. Between the stator and the rotor there is a ring-shaped space that is divided by radially inward extending projections locked in rotation with the stator into a plurality of pressure chambers that are each divided by a vane extending radially outward from the rotor into two work chambers of opposite effective directions. Depending on the charging of the work chambers with a pressurized medium, the rotor is then adjusted in the "advanced" or "retarded" direction relative to the stator and thus also the camshaft relative to the crankshaft.

The rotor can comprise, in addition to the vanes, additional holes for locking pins with which the rotor can be locked in a predetermined angular position by a stator-fixed locking connecting pin. The rotor must further have a certain strength and dimensional stability also at higher operating temperatures and should simultaneously have the lowest possible own weight for low production costs.

To fulfill these requirements, it is known to produce the rotors, e.g., from sintered material, from a high temperature-resistant plastic, or from aluminum, wherein each material has advantages with respect to some functions and disadvantages with respect to other functions. Thus, the use of sintered steel for the rotor basically has the advantage of a very high strength for low production costs, but the disadvantage of a relatively large mass. In contrast, high-quality plastics are basically more expensive, but have lower mass.

In front of this background, the invention is based on the object of creating a rotor that can have improved designs with respect to the stated requirements.

SUMMARY

To achieve this objective, it is provided according to the invention that the rotor has a central passage opening and at least one radially outward projecting vane and that the rotor is formed in at least two parts with an inner part made from a first material and an outer part made from a second material and surrounding the inner part on the outside, wherein the first material has a higher strength than the second material and the inner part is connected by a positive fit to the outer part in the rotational direction with an exterior shape that is irregular or non-circular in cross-section relative to the rotational axis of the rotor. Through the proposed solution, a very economical rotor can be created that has, due to the inner part with the higher strength in the region of the passage opening, a rotor core with high dimensional stability and can be produced with very high dimensional accuracy. Because the strength of the rotor is not of such great importance for its function in the outer section than in the inner section, the rotor can be formed with a lighter weight and/or more economically by the use of an outer part with a lower strength. Here it is especially important for the solution according to the invention that the rotor is formed in two parts with the inner and outer parts, so that different materials can be intentionally used for the rotor. Furthermore, the irregular or non-circular outer shape of the inner part is especially important, because the outer and inner parts can be locked in rotation with each other to form a fixed assembly without additional measures just through joining or injection molding processes.

It is further proposed that the first material is steel and the second material is a temperature-resistant plastic. Temperature-resistant plastics are understood to be plastics that are dimensionally stable up to temperatures from 150 to 200 degrees Celsius. These have the advantage of an especially low specific weight for a nevertheless sufficient strength and can be connected to the steel part very easily through injection molding around the steel part. Furthermore, the pressurized medium lines can be simultaneously shaped during the injection molding process, so that the outer part requires no additional post-processing. As the steel part, preferably a steel sintered part is used that can be produced very economically without a subsequent cutting process and satisfies the required strength for the rotor core. Overall, the proposed solution enables the elimination of the previously required post-processing steps that add to the costs, such as drilling or milling.

It is further provided that the inner part has at least one opening arranged radially outside of the passage opening for holding a locking pin of a locking device. The positional accuracy of the locking pin is especially important for the functionality of the camshaft adjusting device, because the rotor is otherwise locked either not at all or in an incorrect position relative to the stator. Furthermore, in the locked position of the rotor, the forces acting on the rotor are transmitted via the locking pin to the stator, so that the locking pin itself and the rotor in the region of the opening must have a certain dimensional stability and strength. Thus, the arrangement of the opening for the locking pin in the inner part with the higher strength is advantageous. Furthermore, the inner part with the passage opening that is round in cross-section is intentionally formed with an irregular or non-circular exterior shape for creating a rotationally locked connection to the outer part, so that sections with a thicker wall thickness are intentionally formed on the circumference of the passage opening, wherein these sections are used for the arrangement of the opening for the locking pin.

According to another preferred embodiment of the invention, it is provided that the inner part has a parallelogram-like exterior shape in cross-section relative to the rotational axis of the rotor. The parallelogram-like or also diamond-like exterior shape of the inner part enables a uniform transmission of the circumferential forces between the inner and outer parts on both sides of the rotational axis of the rotor. In the ideal case, the inner part is formed point-symmetric to the rotational axis of the rotor, so that the inner part is loaded by identical magnitude circumferential forces on both sides of the rotational axis.

It is further provided that the inner part is oriented relative to the outer part such that the longitudinal axis of the inner part with the greater length runs through the centers of two opposite vanes. Through the proposed orientation of the inner part it is enabled to form the rotor overall symmetric to the axes of the rotor running through the opposite vanes so that the rotor can be formed with equal deformation resistance independent of the rotational direction.

It is further provided that the inner part has two openings arranged diametrically opposite the rotational axis of the rotor for holding two locking pins of a locking device. Through the proposed improvement, the possible imbalance is reduced by ideally compensating for mass changes caused by the openings.

It is further provided that the recesses are arranged such that their centers lie on the longitudinal axis of the parallelogram-like inner part with the larger length. Through the proposed arrangement, the recesses are intentionally arranged in the sections with the largest wall thickness.

Furthermore it is provided that the inner and outer parts each have pressurized medium channels that are connected to each other in terms of flow in an orientation of the outer part relative to the inner part defined by the exterior shape of the inner part. The irregular or non-circular exterior shape of the inner part is thus used, in practice, also as mechanical coding, because the inner part and outer part can be assembled in only one or two orientations due to the irregular or non-circular exterior shape of the inner part. If the outer part is also formed point-symmetric to the rotational axis of the rotor, the inner part can also be inserted into the inner part in two or more orientations, wherein all that is important is that the pressurized medium channels are arranged in the inner and outer parts so that they are connected to each other in terms of flow in the predetermined orientation.

It is further provided that the inner part has a structured surface with increased coefficient of friction. The structured surface with increased coefficient of friction can further reinforce the connection of the outer part to the inner part. Here, the structured surface with increased coefficient of friction can be simultaneously shaped to allow use of a sintered part during the sintering process, wherein the outer part in this case is preferably injection molded around the inner part.

Furthermore, mass-reducing cut-outs can be provided in the outer part. The mass-reducing cut-outs can reduce the own weight of the rotor, which is advantageous in automotive engineering due to the basic goals of reducing weight and fuel consumption in motor vehicles. Furthermore, the reduced mass of the rotor can positively affect the control behavior of the camshaft adjusting device.

Here, the outer part can be reinforced in the region of the cut-outs by a separating wall. The separating wall reinforces the outer part in the area of the cut-outs so that the outer part again has, in the radial direction, the necessary strength to absorb the bearing forces. Here, the separating wall is preferably oriented perpendicular to the rotational axis of the rotor and divides the cut-out into two equal-size side pockets, so that the vanes and the outer part are reinforced in the center.

BRIEF DESCRIPTION OF THE DRAWINGS

Below, the invention is explained in more detail with reference to a preferred embodiment. Shown in detail in the figures are.

DETAILED DESCRIPTION OF THE PREFERRED EMBODIMENTS

Figure 3:
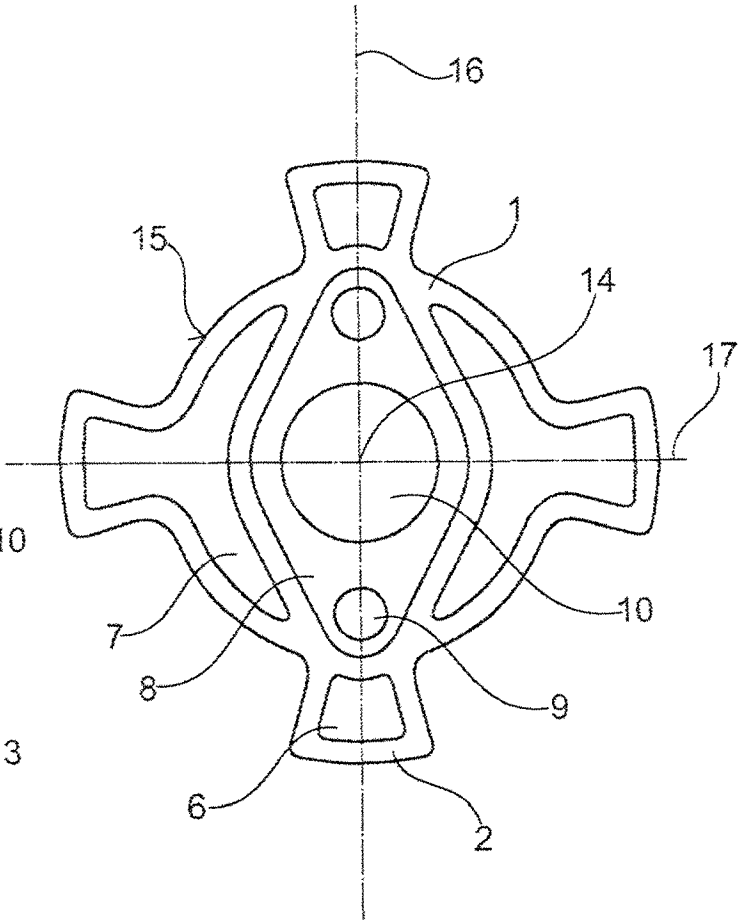
FIG. 3 a rotor according to the invention in front view.
Figure 2:
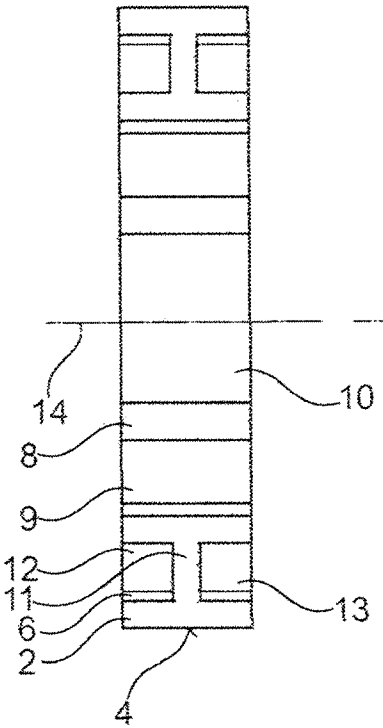
FIG. 2 a rotor according to the invention in section view.
Figure 1:
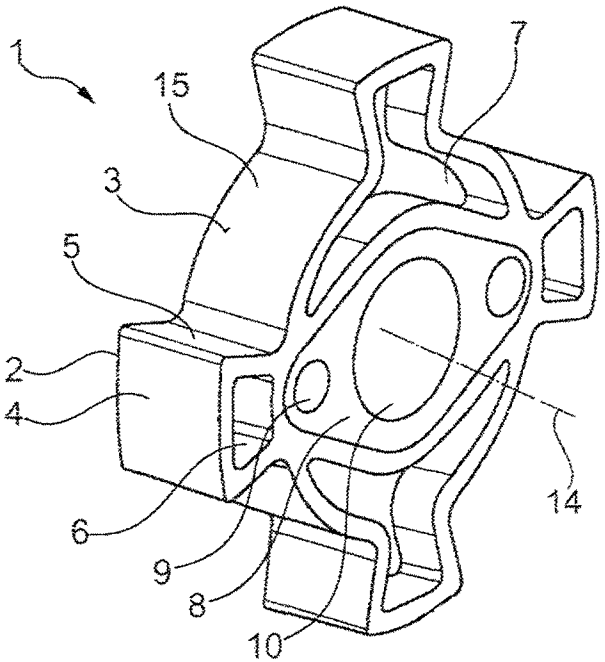
FIG. 1 a rotor according to the invention in perspective view.

In the figures, a rotor 1 can be seen that comprises an inner part 8 and an outer part 3. The inner part 8 is formed by a steel sintered part with a high strength, while the outer part 3 is formed by a plastic that is dimensionally stable up to temperatures of 150 degrees Celsius with a lower strength and a lower specific weight. The outer part 3 is formed by a plastic injection molding around the inner part 8 and reduced in mass by multiple cut-outs 6 and 7. The cut-outs 6 and 7 are each divided by a central separating wall 11 into two equal-size side pockets 12 and 13.

The inner part 8 has a central passage opening 10 and two diametrically opposite openings 9 radially outside of the passage opening 10. The inner part 8 has a parallelogram-like or diamond-like exterior shape, so that due to the central passage opening 10 that is circular in cross-section, opposite sections with a thicker wall thickness are created in which the openings 9 are arranged.

The outer part 3 comprises multiple radially outward extending vanes 2 that each separate oppositely acting work chambers in a not-shown stator. The vanes 2 each have two lateral surfaces 5 that are used for transmitting force from the pressurized medium in the work chambers to the rotor 1. Furthermore, the vanes 2 have, radially outside, a sealing surface 4 with which the vanes 2 contact an opposite sealing surface of the stator. Between the vanes 2, the outer part 3 has radial bearing surfaces 15 by which the rotor 1 is supported on stator-fixed, radially inward extending projections that form, on their side, stationary partition walls of the work chambers.

The diamond-like inner part 8 is positioned and oriented in the outer part 3 such that longer longitudinal axis 16 of the inner part 8 connecting the centers of the openings 9 and the passage opening 10 runs through the centers of two opposing vanes 2, while the perpendicular shorter longitudinal axis 17 also runs through the centers of two opposing vanes 2.

The adjustment of the rotor 1 with the attached camshaft is realized in a known way by a pressurized medium charging of the work chambers on one side of the vanes 2. Through the irregular or non-circular, in this case, diamond-like form of the inner part 8, the forces acting here are transmitted with a positive fit from the outer part 3 to the inner part 8, wherein the force transmission or the connection of the outer part 3 and the inner part 8 can be further increased or reinforced by a structured surface with increased coefficient of friction for the inner part 8 and/or the outer part 3.

In the outer part 3 there are multiple cut-outs 6 and 7 that are each divided by a central separating wall 11 into equal-size side pockets 12 and 13. In this way, the outer part 3 is reinforced relative to the radial forces acting on the radially outer surfaces 4 and the circumferential forces acting between the inner part 8 and the outer part 3. The cut-outs 6 on the vanes 2 that border the tips of the diamond-like inner part 8 are provided only in the vanes 2, while the cut-outs 7 of the vane 2 extend laterally up to below the bearing surfaces 15 of the rotor 1 on the flat sides of the diamond-like inner part 8.

The openings 9 in the inner part 8 for holding the locking pins are arranged so that their centers are on the longitudinal axis 16 of the parallelogram-shaped inner part 8 with the greater length that runs through the center of the passage opening 10. Furthermore, the inner part 8 is oriented relative to the outer part 3 so that the longer longitudinal axis 16 runs through the centers of two opposite vanes 2. In this way, the cut-outs 6 and 7 can have identical shapes in a paired arrangement and can be symmetrical themselves and also relative to the longitudinal axes 16 and 17, so that the rotor 1 and especially the outer part 3 has a stiffness that is independent of the rotational direction.

LIST OF REFERENCE NUMBERS

1 Rotor
2 Vane

3 Outer part
4 Sealing surface
5 Side surface
6 Cut-out
7 Cut-out
8 Inner part
9 Opening
10 Passage opening
11 Separating wall
12 First pocket
13 Second pocket
14 Rotational axis
15 Bearing surface
16 Longitudinal axis
17 Longitudinal axis

The invention claimed is:

1. A rotor for a vane cell adjuster of a camshaft adjusting device, the rotor comprising:

an inner part made from a first material, an outer part made from a second material, a central passage opening in the inner part, the inner part having at least one opening arranged radially outside of the central passage opening and adapted to hold a locking pin of a locking device, at least one vane projecting radially outward on the outer part, the outer part surrounding an entire radial outer surface of the inner part, the first material has a higher strength than the second material, and the inner part is connected by a positive fit to the outer part in a rotational direction by an exterior shape that is non-circular in cross-section relative to a rotational axis of the rotor.

2. The rotor according to claim 1, wherein the first material is steel and the second material is a temperature-resistant plastic.

3. The rotor according to claim 1, wherein the inner part has an exterior that is a parallelogram shape in a plane perpendicular to the rotational axis of the rotor.

4. The rotor according to claim 3, wherein the inner part is oriented relative to the outer part such that a longitudinal axis of the inner part runs through centers of two opposite vanes and through the at least one opening.

5. The rotor according to claim 4, wherein the at least one opening includes two openings arranged diametrically opposite relative to the rotational axis of the rotor for holding two locking pins of a locking device, and the two openings are arranged such that centers thereof lie on the longitudinal axis of the inner part with the greater length.

6. The rotor according to claim 1, wherein the inner and outer parts each have pressurized medium channels that are connected to each other in terms of flow in an orientation of the outer part relative to the inner part predefined by the exterior shape of the inner part.

7. The rotor according to claim 1, wherein the inner part has a structured surface with an increased coefficient of friction.

8. The rotor according to claim 1, wherein mass-reducing cut-outs are provided on the outer part.

9. The rotor according to claim 8, wherein the outer part is reinforced in an area of the cut-outs by a separating wall.

10. The rotor according to claim 9, wherein the separating wall divides the cut-outs into two equal-size side pockets.

* * * * *